US007043885B2

(12) United States Patent
LeMert

(10) Patent No.: US 7,043,885 B2
(45) Date of Patent: May 16, 2006

(54) GLASS BLOCK PANEL SYSTEM AND FABRICATION METHOD OF SAME

(76) Inventor: Steven G. LeMert, 7306 N. Central Ave., Phoenix, AZ (US) 85020

( * ) Notice: Subject to any disclaimer, the term of this patent is extended or adjusted under 35 U.S.C. 154(b) by 117 days.

(21) Appl. No.: 10/661,913

(22) Filed: Sep. 12, 2003

(65) Prior Publication Data

US 2005/0055909 A1 Mar. 17, 2005

(51) Int. Cl.
*E04C 1/42* (2006.01)

(52) U.S. Cl. ..... 52/308; 52/396.1

(58) Field of Classification Search ..... 52/396.1, 52/306–308, 384, 395, 717.03, 747.1, 747.11, 52/747.12

See application file for complete search history.

(56) References Cited

U.S. PATENT DOCUMENTS

| | | | |
|---|---|---|---|
| 692,894 | A | 2/1902 | McQueen |
| 726,639 | A | 4/1903 | Christensen |
| 732,102 | A | 6/1903 | Moulton et al. |
| 1,038,467 | A | 9/1912 | Westendorf |
| 1,167,624 | A | 1/1916 | Chamberlain |
| 2,141,000 | A | 12/1938 | Hohl |
| 2,388,297 | A | 11/1945 | Slaughter |
| 2,708,016 | A | 5/1955 | Penton |
| 2,835,623 | A | 5/1958 | Vincent et al. |
| 2,941,393 | A | 6/1960 | McDavitt et al. |
| 3,160,280 | A | 12/1964 | Burch |
| 3,636,690 | A | 1/1972 | White |
| 3,717,955 | A | 2/1973 | Urbanick |
| 3,729,889 | A | 5/1973 | Baruzzini |
| 3,744,199 | A | 7/1973 | Navarre |
| 4,055,922 | A | 11/1977 | Ellington et al. |
| 4,149,348 | A | 4/1979 | Pyzewski |
| 4,184,297 | A | 1/1980 | Casamayor |
| 4,510,715 | A | 4/1985 | Giguere |
| 4,739,600 | A | 4/1988 | Lynch et al. |
| 4,768,320 | A | 9/1988 | Weller |
| 4,769,961 | A | 9/1988 | Gillet |
| 4,835,921 | A | 6/1989 | Baggett, Jr. et al. |
| 4,839,229 | A | 6/1989 | Jellinek et al. |
| 4,916,876 | A | 4/1990 | Schuyler |
| 4,965,975 | A | 10/1990 | Schwarz |
| 4,969,293 | A | 11/1990 | Guillon |
| 4,970,102 | A | 11/1990 | Guillon |

(Continued)

FOREIGN PATENT DOCUMENTS

DE 3309463 A1 * 9/1984

*Primary Examiner*—Naoko Slack
(74) *Attorney, Agent, or Firm*—Schmeiser, Olsen & Watts

(57) ABSTRACT

A glass block panel system is disclosed that includes glass blocks secured in a framework. The framework includes an external framework having external frame members each of which comprises a base web portion formed between opposing side arms, wherein one of the opposing side arms is removably coupled to the base web portion. The framework also includes an internal framework having internal frame spacers each of which comprises a spacer web portion formed between first and second opposing facing strips, each facing strip comprising cross-arms, wherein at least one of the facing strips is removably coupled to the spacer web portion. The side arms and cross-arms have flexible extrusions protruding from tips thereof. A fabrication method is also disclosed comprising: forming at least a portion of at least one framework compartment; applying adhesive sealant; latitudinally inserting at least one glass block; and completing the glass block panel system.

19 Claims, 6 Drawing Sheets

U.S. PATENT DOCUMENTS 5,007,202 A 4/1991 Guillon
5,010,704 A 4/1991 Thompson
5,014,479 A 5/1991 Yeh et al.
5,031,372 A 7/1991 McCluer
5,042,210 A * 8/1991 Taylor ..... 52/307
5,368,906 A 11/1994 Ferrier nee Pegot et al.
5,430,985 A 7/1995 Coleman
5,448,864 A 9/1995 Rosamond
5,485,702 A 1/1996 Sholton
5,640,819 A 6/1997 Wirkus et al.
5,655,345 A 8/1997 Thompson
5,791,108 A * 8/1998 Conti ..... 52/308
5,806,263 A 9/1998 Coleman
5,845,443 A 12/1998 Wirkus et al.
5,890,331 A 4/1999 Hope
5,992,111 A * 11/1999 Waterhouse ..... 52/308

* cited by examiner

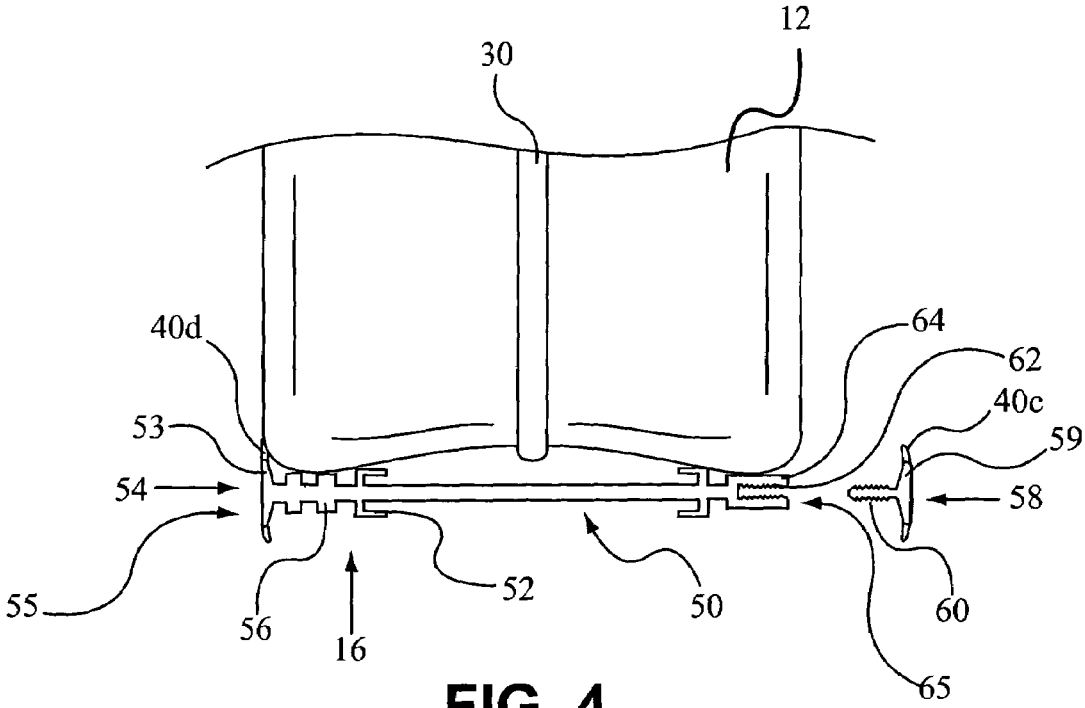
FIG. 4
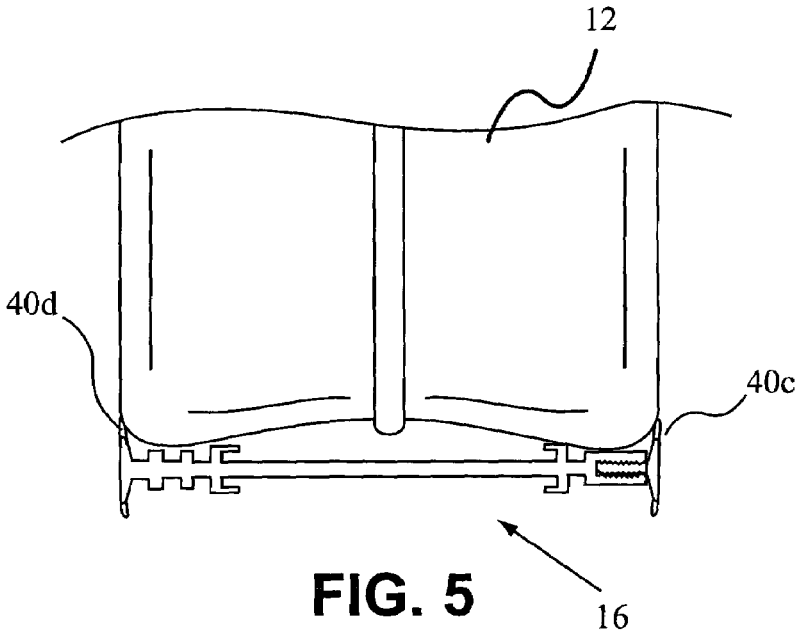
FIG. 5
FIG. 6
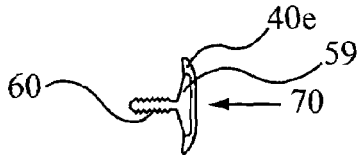

GLASS BLOCK PANEL SYSTEM AND FABRICATION METHOD OF SAME

BACKGROUND OF THE INVENTION

1. Technical Field

This invention generally relates to a glass block panel system and a fabrication method of the same that allows the system to be pre-assembled and shipped to an installation location.

2. Background Art

Glass has many qualities that make it well-suited for use in windows, including transparency or translucency, hardness, imperviousness to the natural elements, insulating properties, and an ability to be formed into various shapes. Windows, walls, and other partitions have long been formed from glass blocks which admit the passage of light but, because of their thickness, do not permit a clear view of objects beyond the glass. Thus, glass block is ideal for any situation or setting where both natural illumination and privacy are important.

Individual glass blocks are assembled into glass block structures by attaching a material to the blocks that bonds the blocks together. This material typically is in the form of a mortar or a spacer adapted to provide a trough or groove between blocks into which caulking is placed.

The conventional construction of a glass brick structure using mortar is a task that requires a great deal of skill and experience. Without such experience, it is difficult to properly position the glass blocks so that they lie in level courses and so that they are securely held in place within the structure. The construction must also be carefully timed so that the mortar is not subjected to excessive weight before it is able to withstand such stress without being forced from between the blocks. These requirements substantially increase the expense and difficulty that attends the installation of a glass block structure. Further, glass brick structures fabricated using mortar are not flexible and do not adequately accommodate settling or other movements that may affect the structure.

The conventional construction of a glass block structure using a spacer also has its drawbacks. Notably, glass blocks tend to have slight variations in geometry that lead to construction difficulties related to spacers. Often, when two halves of a glass block are heated together, the halves do not match up. Thus, when the blocks are installed in a paneled structure, spacers may not create a sufficient seal between block layers due to the variations in the blocks. When the spacers do not seal the blocks and panels completely, water, dirt, pests, and the like may get into the structure through holes or gaps left in the faulty seal. Once water gets into the paneled structure, it pools at the bottom of the paneling and thereby fosters mold and unwanted discoloration. In addition, gaps in the seal lessen the insulating capability of the paneled structure because air may escape through the unwanted orifices.

A further drawback associated with construction of a glass block structure using spacers relates to burdensome fabrication methods corresponding to conventional framework and paneling assemblies. Because of the standard geometries of conventional framework/paneling assemblies, artisans are constrained in the mode of insertion of a glass block into the structure. That is, artisans have to insert the block vertically from the top of the structure. Artisans pre-apply caulking to the framework/paneling assembly prior to insertion of a glass block. Then as the block is longitudinally inserted into the framework/paneling from the top of the framework/paneling, the caulking is scraped and smashed down the length of the vertical frames/panels ultimately building up into an unwanted mass of residual sealant. Artisans then have to manage the removal and disposition of the resulting accumulation of caulking. Thus, conventional construction of glass block structures tends to be messy and arduous and artisans are restricted in the manner by which they may assemble the glass blocks.

Therefore, there exists a need to provide an improved flexible glass block panel system that is configured to prevent gaps and holes in the spacer seal and an improved method of fabrication of the glass block panel system that reduces the need to manage excessive sealant build-up and provides more efficient ways of inserting glass blocks into the structure.

DISCLOSURE OF THE INVENTION

According to the present invention, a glass block panel system is provided that may be supported by a framework comprising at least one compartment. The framework may be flexible and may include an external peripheral framework having external frame members. Additionally, the framework may include an internal framework comprising at least one internal frame spacer. Furthermore, the framework may include a plurality of internal frame spacers that may be interconnected to provide a plurality of juxtaposed compartments that may be formed within the external peripheral framework wherein glass blocks may be readily mounted to define a glass block panel. Moreover, the framework may be configured such that the internal framework and external peripheral framework form juxtaposed compartments corresponding to glass blocks, wherein the geometries of the blocks are not limited to any particular shape. For example, the blocks may be rectilinear (e.g. square, rectangular, triangular, hexagonal, or octagonal) or curvilinear (e.g. circular or elliptical) in shape.

In one embodiment of the invention, a glass block panel system comprises at least one glass block secured in a framework. The framework is comprised of an external framework having at least one external frame member that comprises a base web portion. The base web portion of the external frame member is formed between first and second opposing side arms, wherein one of the opposing side arms is removably coupled to the base web portion.

In another embodiment of the invention, a glass block panel system comprises at least two glass blocks secured in a framework. The framework comprises an internal framework having at least one internal frame spacer that abuts and separates the at least two glass blocks. The internal frame spacer comprises a spacer web portion formed between first and second opposing facing strips, each facing strip comprising cross arms. The cross arms may have flexible extrusions protruding from tips of the cross arms that form tightly adjustable seals between the tips of the cross arms and the glass blocks.

In still another embodiment, a glass block panel system comprises a framework having an external framework and an internal framework. The external framework may comprise external peripheral frame members. Each external frame member may include a base web portion extending a length of the frame member. Formed on an internal face of the base web portion may be a securing track comprising a flanged channel, wherein side walls of the channel have an inwardly protruding flange member formed on exposed ends thereof. The securing track may extend longitudinally along a length of the base web portion. Removably coupled on an external face of and along the length of the base web portion adjacent a first longitudinal end and protruding perpendicularly outwardly therefrom may be a reversible mounting fin. The mounting fin may be removably coupled to the base web portion. Formed along the length of the first longitudinal end of the base web portion and protruding coaxially outwardly therefrom may be a stop. Also formed along the length of the first longitudinal end of the base web portion and protruding perpendicularly outwardly therefrom may be a first supporting side arm. Removably coupled along the length of a second longitudinal end of the base web portion and protruding perpendicularly outwardly therefrom may be a second supporting side arm. Together, the supporting side arms and the base web portion may generally form a channel-shape in cross-section.

Each internal frame spacer may include a web portion that extends a length of the frame spacer. Formed along the length of a first longitudinal end of a spacer web portion and protruding coaxially outwardly therefrom may be a narrow ribbed receptacle that may be substantially U-shaped in cross-section. The receptacle may be configured to receive a ribbed web portion of a facing strip that may be generally T-shaped in cross-section (i.e. may have cross-arms coupled along a length of one longitudinal end of the ribbed web portion). Formed along a length of a second longitudinal end of the spacer web portion may be cross-arms, thereby rendering the internal frame spacer substantially T-shaped in cross-section. Formed on each opposing face of the spacer web portion may be a securing track comprising a flanged channel, wherein side walls of the channel have inwardly protruding flange members formed on exposed ends thereof. The securing track may extend longitudinally along a length of the spacer web portion. Also formed on each opposing face of the spacer web portion between each cross-arm of the second longitudinal end of the spacer web portion and each securing track may be at least one perpendicularly protruding rib that extends longitudinally along a length thereof. Formed at each opposing latitudinal end of the spacer web portion and protruding coaxially outwardly therefrom may be a securing tab configured to interconnect with any of the securing tracks of the internal frame spacers and the external peripheral frame members of the glass block panel system.

The supporting side arms of the peripheral frame members, the cross-arms of the internal frame spacers, and the cross-arms of the facing strips each may have a flexible extrusion coupled along and extending outwardly from each of the exposed ends (tips) thereof. The flexible extrusions may be in an angled position. In this way, the flexible extrusions may flex back from their bent position while abutting the installed glass blocks, thereby creating a seal between the blocks and the extrusions. Thus, the length, angle, and especially the flexibility of the flexible extrusions allow them to compensate for virtually any gap between the installed blocks and the extrusions while still forming a seal between the blocks and the extrusions.

Generally, a fabrication method of the present invention may form a glass block panel system by: forming at least a portion of at least one framework compartment; applying adhesive sealant; latitudinally inserting at least one glass block; and completing the glass block panel system.

In one embodiment of the invention, fabricating a glass block panel system may begin with positioning an external bottom frame member in place. Then, the bottoms of the external upright channeled frame members and the inner upright frame spacers may be positioned in place spaced apart along the external bottom frame member. Next, an external upper frame member may then be positioned in place along the tops of the external upright frame members and the inner upright frame spacers so that the external peripheral framework is assembled and forms a plurality of juxtaposed compartments.

Then, silicone caulking or some other adhesive sealant may be applied to: both the inner bottom surface and the inner surface of the back side of the bottom frame member; the inner surfaces of the back sides of the external upright frame members; the inner surfaces of the cross-arms of the upright frame spacers; and both the inner bottom surface and the inner surface of the back side of the upper frame member. Next, glass blocks may then be laterally inserted into the compartments from the front of the assembled external peripheral framework.

Then, silicone caulking for example or some other adhesive sealant may be applied to the inner surfaces of the cross-arms of the facing strips (or to portions of the glass block panel system to be covered by the inner surfaces of the cross-arms of the facing strips). Finally, the web portions of the facing strips may be inserted into the receptacles of the inner upright frame spacers so as to complete the glass block panel system. If other rows or courses of positioned blocks are necessary, the foregoing fabrication method may be modified by interposing additional internal frame spacers horizontally between vertically positioned external peripheral frame members and vertically positioned frame spacers to form subsequent pluralities of juxtaposed compartments.

The foregoing and other features and advantages of the invention will be apparent from the following more particular description of embodiments of the invention, as illustrated in the accompanying drawings.

BRIEF DESCRIPTION OF THE DRAWINGS

Embodiments of the present invention will hereinafter be described in conjunction with the appended drawings, where like designations denote like elements.

FIGS. 4–5 are end views of glass block components in conjunction with internal frame spacer components according to an embodiment of a glass block panel system of the invention.

FIG. 6 is an end view of an alternate removably coupled facing strip configured according to an embodiment of the invention.

DETAILED DESCRIPTION OF THE INVENTION

The invention is particularly useful in facilitating the assembly of compartmentalized frameworks useful in the fabrication of straight or radius glass block panel systems. Generally, straight or radius glass block panel systems according to embodiments of the invention are used in construction of translucent structures included in walls.

However, it will be understood by those of ordinary skill in the art that glass block panel systems according to embodiments of the invention are not limited to uses relating to construction of translucent structures included in walls. Rather, those of ordinary skill in the art will also understand that glass block panel systems according to embodiments of the invention may also be used in a variety of applications with similar results for a variety of structures, such as translucent bridges, translucent floors, translucent ceilings, translucent roofs, and the like for structures including, for example: dwellings, commercial buildings, monuments, greenhouses, components of sea vessels, stadium bleachers, and roads.

Figure 1:
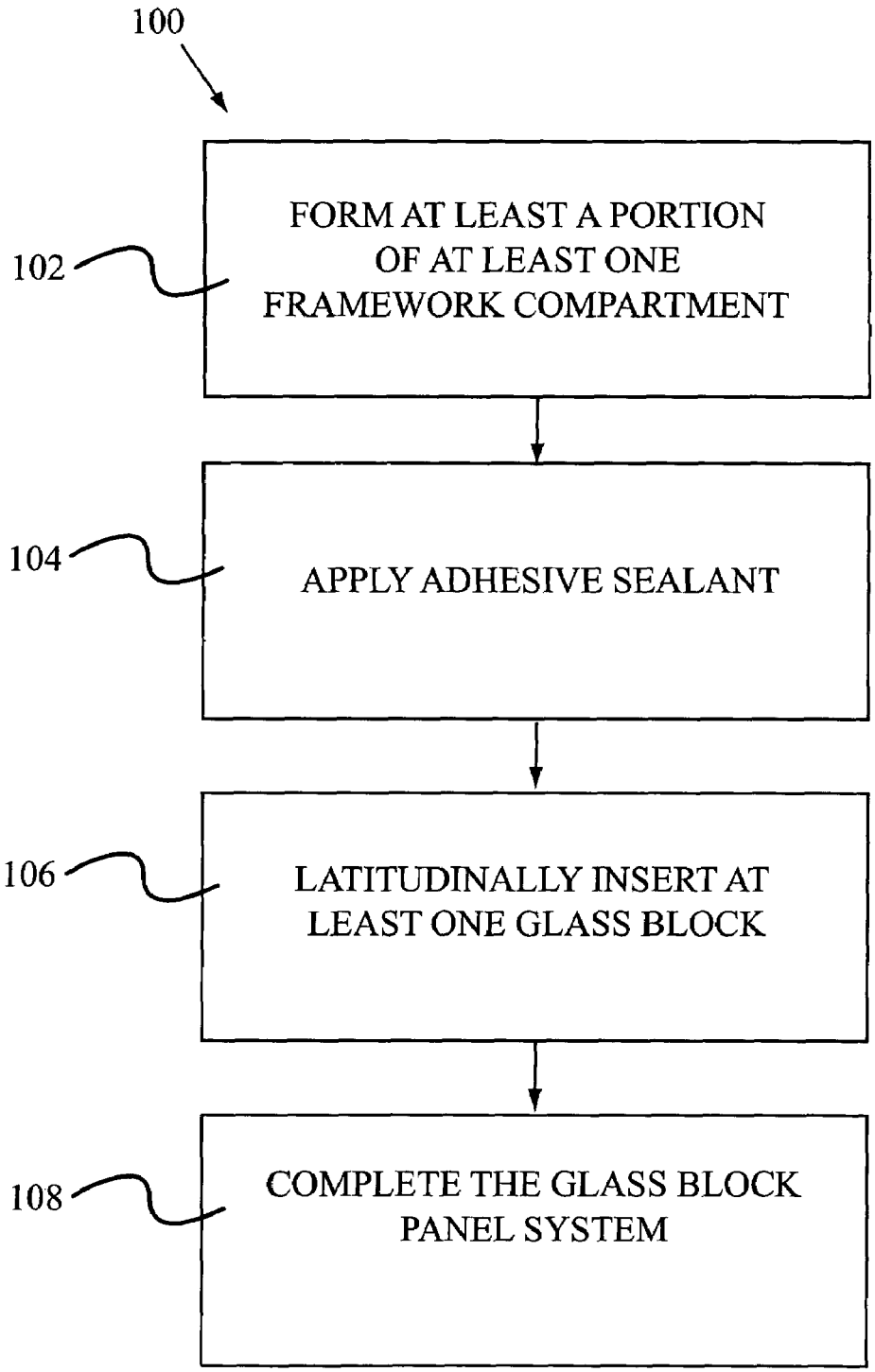
FIG. 1 is a flow diagram depicting a fabrication method according to an embodiment of the invention.

The invention may be readily adapted to a variety of embodiments of a method for fabricating glass block panel systems supported by frameworks according to embodiments of the invention. With reference to FIG. 1, fabrication method 100 is an example of a fabrication method of the invention. Generally, and for the exemplary purposes of this disclosure, method 100 of the present invention may form a glass block panel system by: forming at least a portion of at least one framework compartment (step 102); applying adhesive sealant (step 104); latitudinally inserting at least one glass block (step 106); and completing the glass block panel system (step 108). As will become apparent, method 100 forms glass block panel systems in a manner that improves the efficiency of fabrication, enhances the sealant capabilities, and increases the versatility of glass block panel systems.

Glass block panel systems according to embodiments of the present invention may be comprised of a framework comprising an external peripheral framework and an internal framework that may be interconnected to provide a plurality of juxtaposed compartments wherein glass blocks may be readily mounted to define a glass block panel. Glass blocks may be arranged in generally horizontal rows or courses defined by the framework. The courses may be arranged in vertical fashion one atop another forming columns until glass block panel systems achieve desired heights. Within a glass block panel system, individual glass blocks are conventionally of substantially similar size and shape, and are aligned with each other such that there is little or no offset or overlap between a glass block in a first course and corresponding glass blocks in other courses above or below the first course. Glass block panel systems may comprise any number of glass blocks arranged in any number of courses, where the courses themselves may contain any number of glass blocks. Conventionally, every course within a glass block panel system may contain an identical number of glass blocks. The framework may be bonded to individual glass blocks with an adhesive sealant. Furthermore, the framework may be configured so as to allow latitudinal insertion of glass blocks into the framework from a front face of the glass block panel system. Moreover, framework may be configured to tightly, yet adjustably, secure and seal glass blocks within the framework when the glass block panel system is fully assembled.

Figure 7:
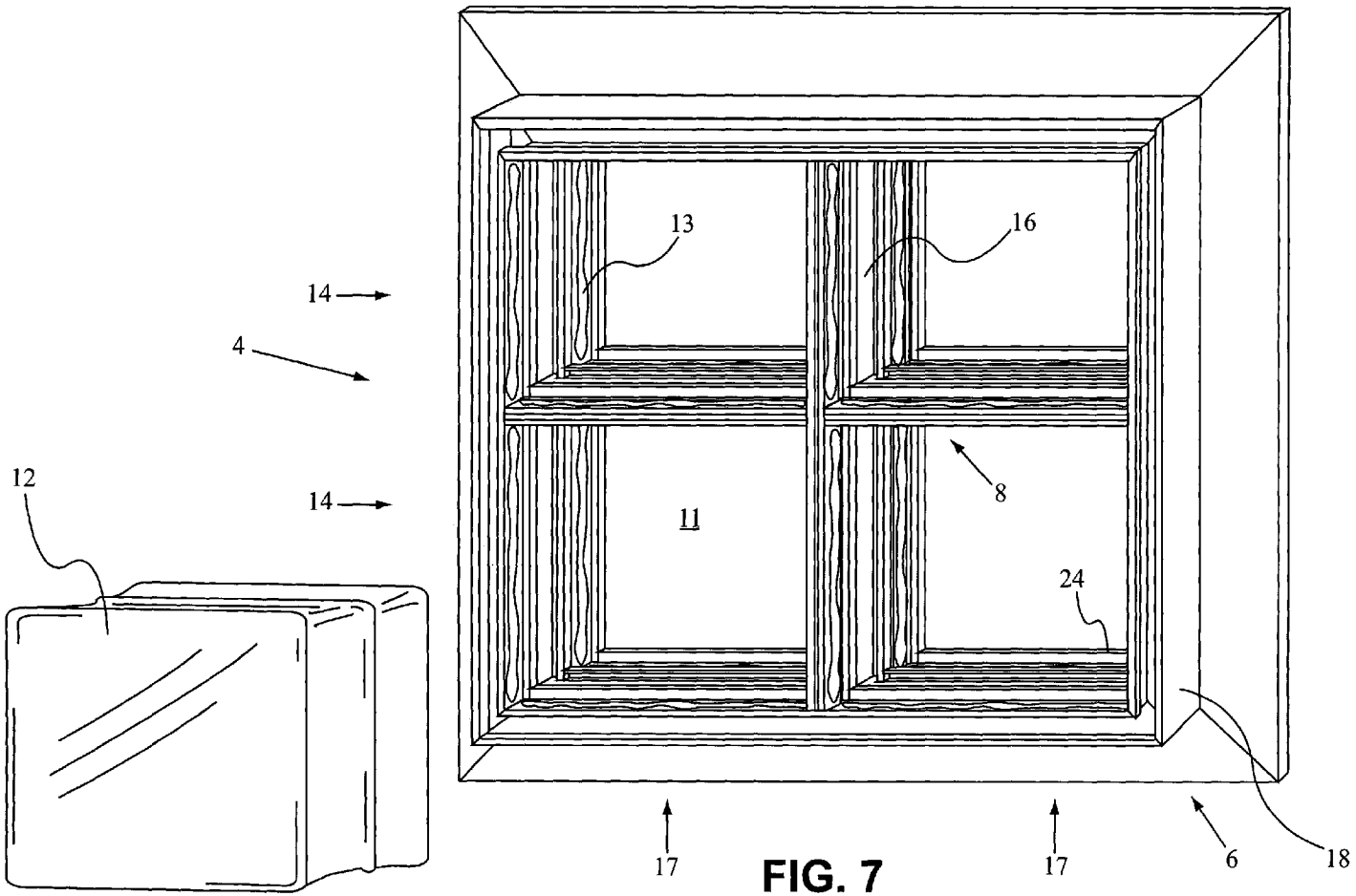
FIGS. 7–9 are perspective views of a glass block panel system according to an embodiment of the invention during the fabrication method of FIG. 1.
Figure 8:
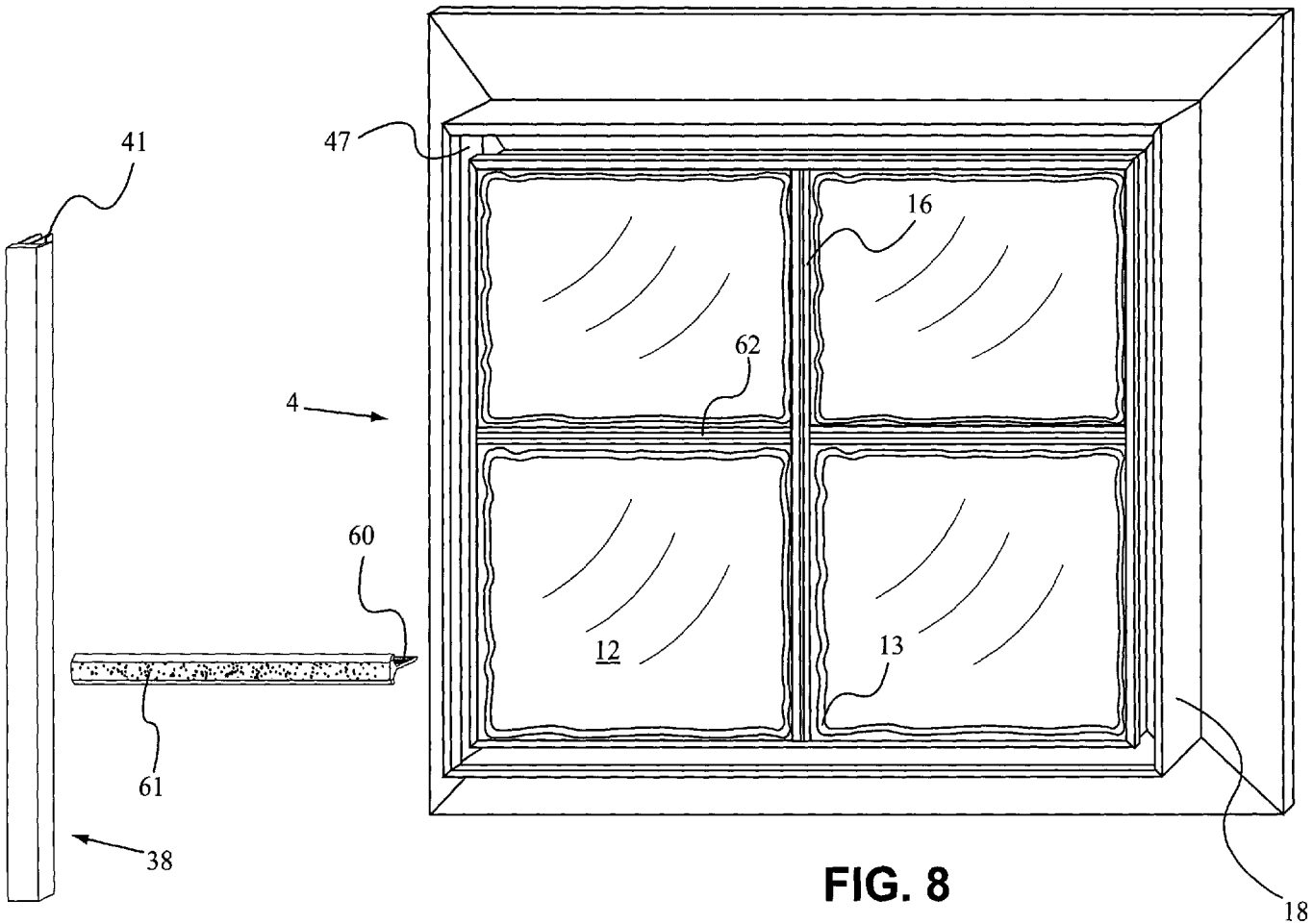
Figure 9:
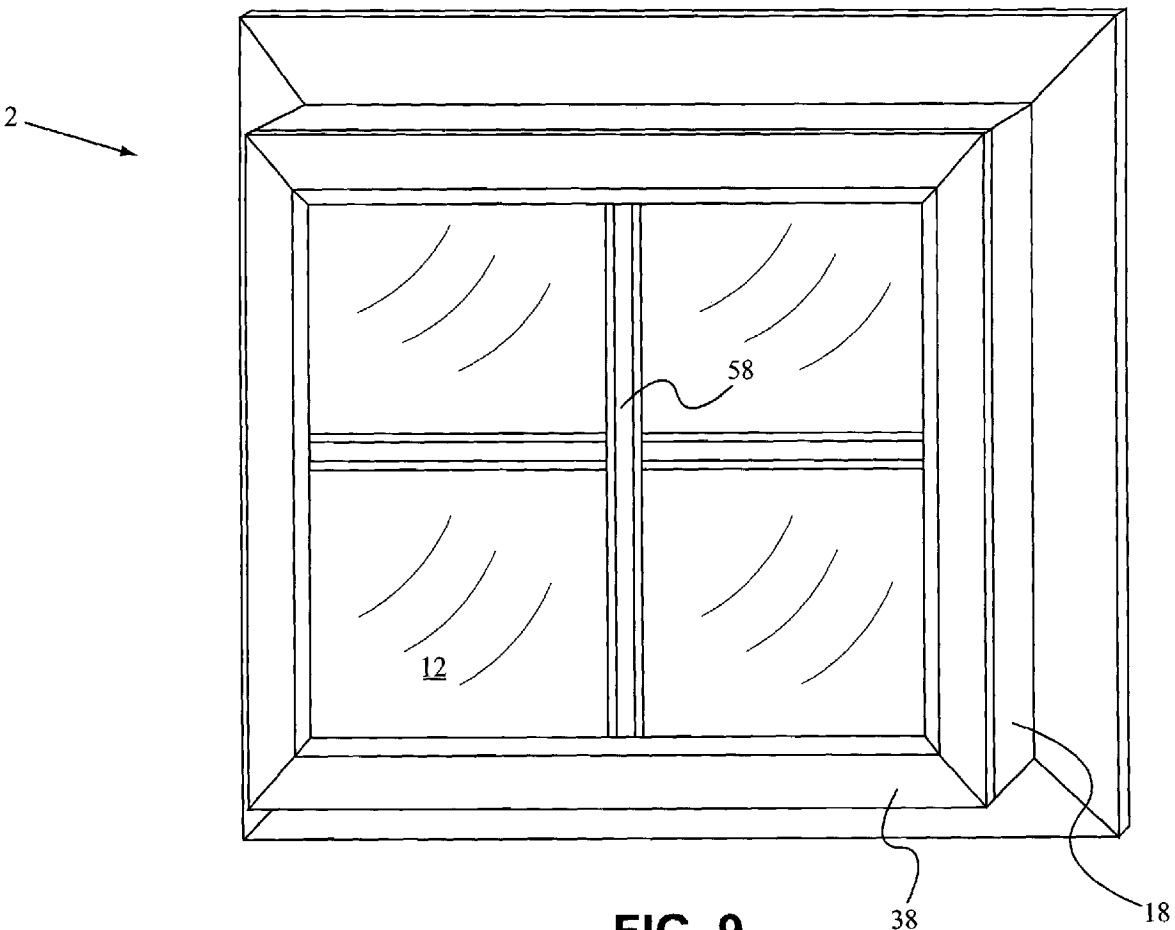

Although the invention may be readily adapted to a variety of embodiments of a glass block panel system, for the exemplary purposes of this disclosure, glass block panel system 2 is an example of an embodiment of a glass block panel system of the invention. Accordingly, in describing fabrication method 100, reference will be made to FIGS. 2–9 in which the structures of glass block panel system 2 are depicted. FIGS. 7–9 are perspective views depicting various fabrication stages of glass block panel system 2 during method 100, while FIGS. 2–5 are end views depicting various components used in forming glass block panel system 2.

As depicted, glass block panel system 2 is comprised of supporting framework 4 comprising external peripheral framework 6 and internal framework 8. External peripheral framework 6 encompassing glass blocks 12 and comprises external peripheral frame members 18 having reversibly coupled mounting fins 20 and removably coupled side arms 38. Internal framework 8 is comprised of internal frame spacers 16 arranged between glass blocks 12 to provide greater symmetry and structural support. Internal frame spacers 16 comprise removably coupled facing strip 58.

Optionally, the exterior surface of removably coupled facing strip 58 may comprise texture 61 for better performance and easier installation. Texture 61 may be integrally joined to or coupled with facing strip 58. Texture 61 may have the look and feel of conventional mortar for example, but not the disadvantages. Texture 61 may allow a fabricator to better grip and install facing strip 58 during the fabrication of glass block panel system 2 for example.

Alternatively, as depicted in FIG. 6, removably coupled facing strip 70 may be employed in place of facing strip 58. Facing strip 70 comprises the same components as facing strip 58, the only difference being the inclusion of flexible cover 40*e* in place of flexible tips 40*c*. Flexible cover 40*e* provides both flexible tips and an overlay over the outer surface of cross-arm 59 of facing strip 70. The overlay maintains uniformity and continuity in sheen, texture, and material in the glass block panel system. That is, the overlay overcomes the drawback found in facing strip 59, namely the unappealing appearance of lines that are present between flexible tips 40*c* and cross-arm 59 of facing strip 58 as depicted in FIG. 9.

External peripheral framework 6 and internal framework 8 are interconnected to provide plurality of juxtaposed compartments 11 wherein glass blocks 12 are readily mounted to define glass block panel system 2. Glass block panel system 2 is further comprised of individual glass blocks 12 arranged in generally horizontal courses 14 defined by framework 4. Framework 4 is bonded to individual glass blocks 12 with adhesive sealant 13 that is placed in framework 4 so as to lie at or near the corners and/or the edges of blocks 12. Furthermore, framework 4 is configured so as to allow latitudinal insertion of glass blocks 12 into framework 4 from a front face of glass block panel system 2. Moreover, framework 4 is configured to tightly, yet adjustably, secure and seal glass blocks 12 within framework 4 when glass block panel system 2 is fully assembled.

Notwithstanding, it will be understood by those of ordinary skill in the art that the invention is not limited to the specific structures illustrated in the drawings, as any structures known in the art consistent with the intended mechanical operation of a glass block panel system of the present invention may be utilized. Accordingly, for example, although particular ribs, channels, flanges, tracks, fins, tabs, stops, protrusions, cross-arms, framework members, spacers, web portions, side arms, facing strips, texture, receptacles, glass blocks, extrusions, and other components are illustrated in the drawings, such components may comprise any shape, size, style, measurement, material, and/or the like as is known in the art for such components consistent with the intended mechanical operation of a glass block panel system of the invention. It will also be understood by those of ordinary skill in the art that the invention is not limited to use of any specific components, provided that the components selected are consistent with the intended mechanical operation of a glass block panel assembly of the invention.

Furthermore, the components defining any embodiment of a glass block panel system of the invention may be formed of any of many different types of materials or combinations thereof that may readily be formed into shaped objects provided that the components selected are consistent with the intended mechanical operation of a glass block panel system of the invention. For example, the components may be formed of rubber (synthetic and/or natural), glass, composites such as fiberglass, carbon-fiber and/or other like materials, polymers such as plastic, polycarbonates, PVC plastic, ABS plastic, polystyrenes, acyclic, nylon, phenolics, any combination thereof, and/or other like materials, metals, such as zinc, magnesium, titanium, copper, iron, steel, any combination thereof, and/or other like materials, alloys, such as aluminum, and/or other like materials, any other suitable material, and/or any combination thereof.

Moreover, the components defining any glass block panel system embodiment of the invention may be purchased pre-manufactured and/or manufactured separately and then assembled together. However, some of the components may be manufactured simultaneously and integrally joined with one another provided that the components selected are consistent with the intended mechanical operation of a glass block panel system of the invention. Glass blocks are manufactured by a number of companies. One of these is the Pittsburgh Corning Corporation of Pittsburgh, Pa., which, as is typical of glass block manufactures, offers a wide variety of face patterns and finishes, block shapes, and product specifications. Glass blocks 12 used by the present invention may be those manufactured by any manufacturer. Regardless of their source, all glass blocks are made by fusing together pressed and molded glass halves. Manufacture of the other components defining any glass block panel system embodiment of the invention may involve extrusion, pultrusion, injection molding, resin transfer molding, casting, milling, stamping, cutting, welding, soldering, riveting, punching, and/or the like. If any of the components are manufactured separately, they may then be coupled with one another in any manner known in the art, such as with adhesive (e.g. silicone caulking), a weld, a fastener (e.g. a bolt, a screw, a nail, and the like), any combination thereof, and/or the like for example, depending on, among other considerations, the particular material forming the components. Other possible assembly steps might include interlocking male and female components via engagement of pre-formed inserts and receptacles, bending the components into particular geometries, and/or texturing the components for better performance and easier installation.

Figure 2:
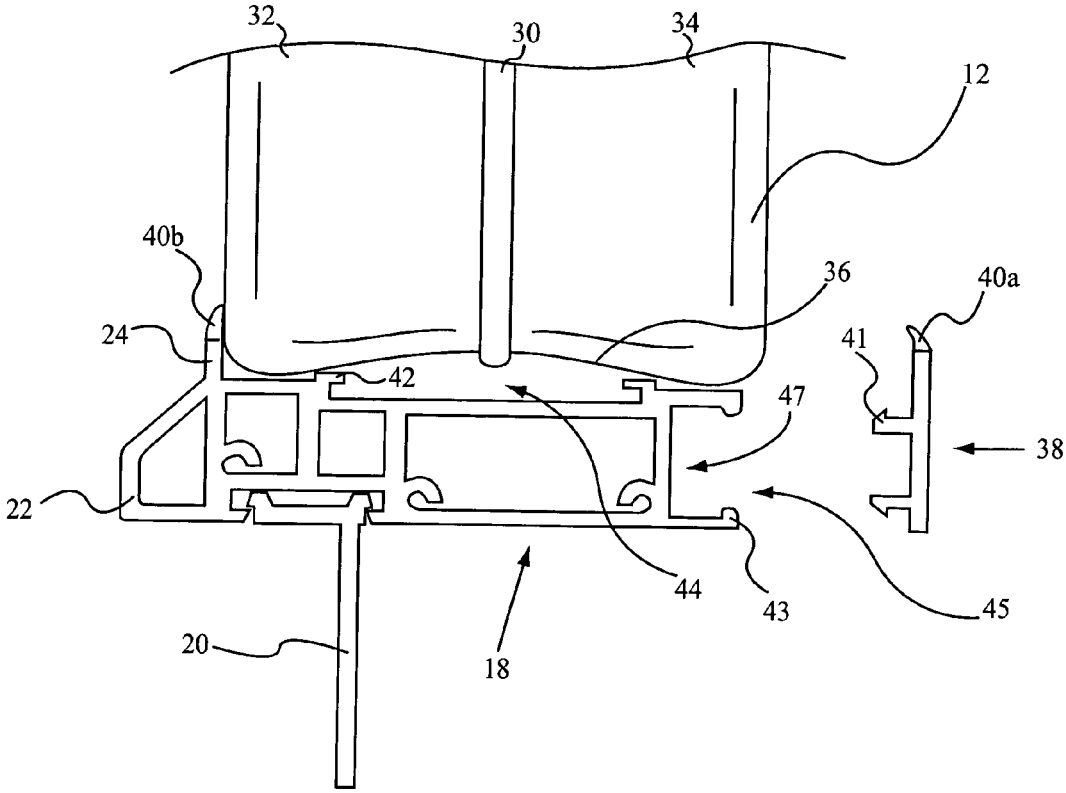
FIG. 2 is an end view of a glass block component in conjunction with an external peripheral frame member component according to an embodiment of a glass block panel system of the invention.
Figure 3:
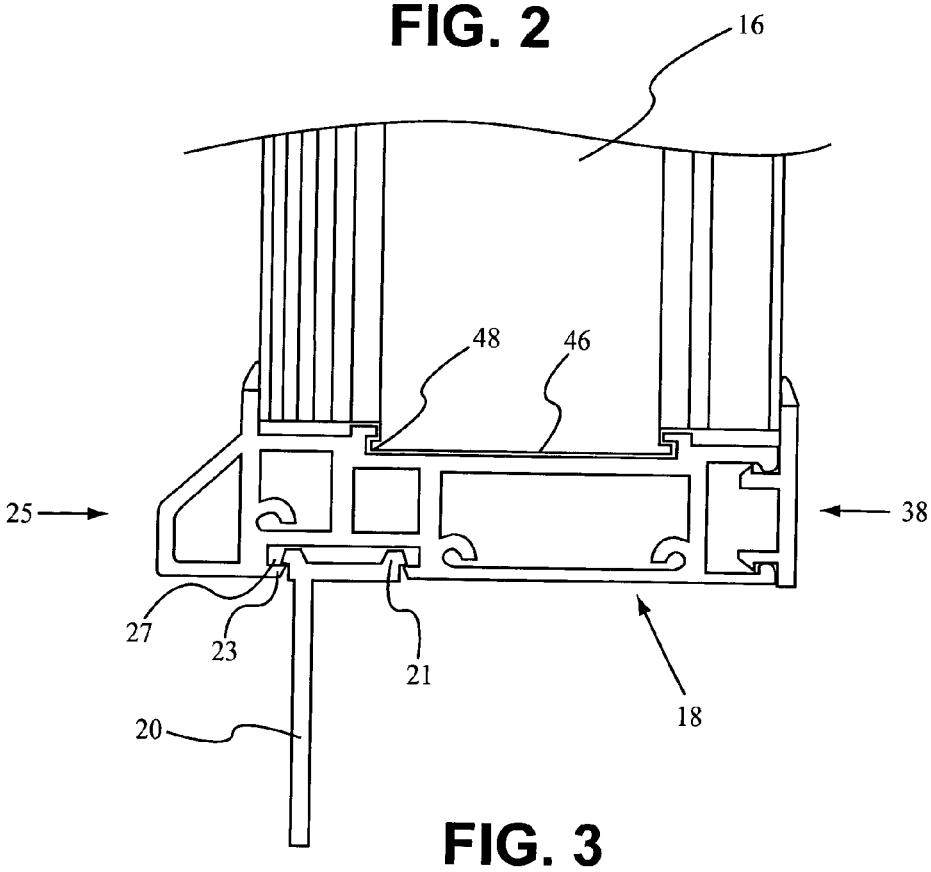
FIG. 3 is an end view of an internal frame spacer component in conjunction with an external peripheral frame member component according to an embodiment of a glass block panel system of the invention.

For example, external peripheral frame member 18 and mounting fin 20 may be removably coupled to one another as depicted in FIGS. 2 and 3, or may be integrally joined together into an indistinct unitary component. Additionally, as also depicted in FIGS. 2 and 3, the components formed along the length of first longitudinal end 25 of the base web portion of peripheral frame member 18, including supporting side arm 24 and stop 22 protruding coaxially outwardly therefrom, may be integrally joined to one another, and integrally joined to the base web portion of peripheral frame member 18. Similarly, the components defining facing strip 54 of internal frame spacer 16 as depicted in FIGS. 4 and 5, may be integrally joined to one another, and integrally joined to the base web portion of internal frame spacer 16. Likewise, the components defining facing strip 58 as depicted in FIGS. 4 and 5, may be integrally joined to one another. However, facing strip 58 and internal frame spacer 16 may be removably coupled to one another as depicted in FIGS. 4 and 5. Furthermore, flexible tips 40*a*–40*d* illustrated in FIGS. 2–5 may be co-extruded with their corresponding other components and therefore integrally joined, or tips 40*a*–40*d* and their corresponding other components may be distinct portions coupled together with their corresponding other components.

Referring back to FIG. 1 and describing method 100 in greater detail, step 102 of method 100 is to form at least a portion of at least one framework compartment. Forming at least a portion of at least one framework compartment in step 102 may involve any number of steps and implementing components, and forming at least a portion of at least one framework compartment may be accomplished readily by those with ordinary skill in the art from the disclosure herein. Accordingly, in one embodiment of the invention, forming at least a portion of at least one framework compartment may be accomplished by forming at least one framework compartment. In other embodiments of the invention, forming at least a portion of at least one framework compartment may be accomplished by forming portions of a plurality framework compartments or forming a plurality framework compartments.

For the exemplary purposes of this disclosure and turning to FIG. 7, step 102 in fabrication method 100 of forming at least a portion of at least one framework compartment may be accomplished by forming framework compartments 11. This step may be accomplished by forming framework 4 of glass block panel system 2.

In assembling framework 4, external framework 6 may be formed having external peripheral frame members 18. A first external peripheral frame member 18 may be positioned horizontally so as to comprise a base of glass block panel system 2. Then, a second peripheral frame member 18 may be positioned vertically and coupled to the first peripheral frame member 18 so as to comprise a left side of the glass block panel system 2. Next, a third peripheral frame member 18 may be positioned vertically and coupled to the first peripheral frame member 18 so as to comprise a right side of the glass block panel system 2. Finally, a fourth external peripheral frame member 18 may be positioned horizontally and coupled to both the first and second peripheral frame members 18 so as to comprise a top of glass block panel system 2.

Internal framework 8 may be formed having internal frame spacers 16. A first internal frame spacer 16 may be positioned vertically and coupled to both the first and fourth peripheral frame members 18 so as to comprise the central portion of panel system 2. Once first frame spacer 16 has been positioned, then second and third internal frame spacers 16 may be positioned horizontally and coupled to the second peripheral frame member 18 and first frame spacer 16 and the third peripheral frame member 18 and first frame spacer 16 respectively, thereby forming juxtaposed compartments 11 comprising lower and upper courses 14 and right and left columns 17 of glass block panel system 2.

It will be understood by those skilled in the art that other assembly methods consistent with the intended mechanical operation of a glass block panel system of the invention may be substituted. For example, the third external peripheral frame member 18 may be positioned vertically before the second peripheral member 18 is positioned. Also, the first internal frame spacer 16 may be centrally positioned vertically prior to the fourth external peripheral frame member 18 being positioned horizontally. Additionally, the first internal frame spacer 16 may be centrally positioned vertically prior to the third peripheral frame member 18 being positioned. Furthermore, if other courses 14 of positioned glass blocks 12 are necessary, additional internal frame spacers 16 may be horizontally interposed between the vertically positioned external peripheral frame members 18 and vertically positioned frame spacers 16 to form subsequent pluralities of dimensionally similar juxtaposed compartments 11. Moreover, framework 4 may be left open and only partially completed while the glass block panel system is fabricated according to method 100. That is, each course 14 of positioned glass blocks 12 may be formed according to steps 102–106 of method 100. Then, once all courses 14 have been completed, top horizontally positioned peripheral frame member 18 may be positioned as set forth above during step 108 of method 100.

During framework 4 assembly, various framework components may be connected to one another. For the exemplary purposes of this disclosure, FIGS. 2–7 depict components of some embodiments of the invention that facilitate the connection of peripheral frame members 18 and frame spacers 16. By inserting T-shaped securing tab 46 of frame spacer 16 into securing track 44 of peripheral frame member 18, a secure connection may be achieved between peripheral frame member 18 and internal frame spacer 16. Similarly, a first internal frame spacer 16 may be connected to a second internal frame spacer 16 by inserting T-shaped securing tab 46 of the first frame spacer 16 into securing track 50 of the second frame spacer 16. The illustrated embodiment formed according to method 100 and shown in FIGS. 6–8 depicts peripheral frame members 18 with mitered ends that may be coupled to one another in any manner known in the art, such as with adhesive (e.g. silicone caulking, glue, and the like), a weld, a fastener (e.g. bolts, screws, nails and the like), any combination thereof, and/or the like for example, depending on, among other considerations, the particular material forming the components.

Step 104 of method 100 is to apply adhesive sealant. Applying adhesive sealant in step 104 may involve any number of steps and implementing components, and applying adhesive sealant may be accomplished readily by those with ordinary skill in the art from the disclosure herein. Accordingly, in one embodiment of the invention, applying adhesive sealant may be accomplished by applying adhesive sealant to predetermined areas of the portion of the framework compartment. In other embodiments of the invention, applying adhesive sealant may be accomplished by applying adhesive sealant to the portion of the framework compartment so as to lie at or near the corners and/or the edges of the glass blocks when they are installed. In still other embodiments of the invention, applying adhesive sealant may be accomplished by applying adhesive sealant to: 1) both the inner bottom surface and the inner surface of the back side of the bottom frame member; 2) the inner surfaces of the back sides of the external upright frame members; 3) the inner surfaces of the cross-arms of the upright frame spacers; and 4) both the inner bottom surface and the inner surface of the back side of the upper frame member.

For the exemplary purposes of this disclosure and still referring to FIG. 7, step 104 in fabrication method 100 of applying adhesive sealant may be accomplished by applying adhesive sealant 13 to framework compartment 11 portions that lie at or near the corners and the edges of glass blocks 12. Accordingly, this step may be accomplished by applying adhesive sealant 13 between glass blocks 12 and internal frame spacers 16 along the longitudinal length of the base web portions of frame spacers 16. Adhesive sealant 13 also may be applied between glass blocks 12 and external peripheral frame members 18 along the longitudinal length of base web portions of peripheral frame members 18. Adhesive sealant 13 holds glass block panel system 2 together by bonding glass blocks 12 to framework 4. More specifically, adhesive sealant 13 bonds internal frame spacers 16 and peripheral frame members 18 to glass blocks 12. Silicone is one such adhesive sealant that works well in conjunction with the present invention, although it will be understood by those skilled in the art that any adhesive sealant consistent with the intended mechanical operation of a glass block panel system of the invention may be substituted. When silicone, for example, is applied along the longitudinal lengths of the base web portions of internal frame spacers 16 and peripheral frame members 18, it experiences pressure caused by the presence of an inserted glass block 12 and spreads out along the interfacing surfaces of internal frame spacers 16 and peripheral frame members 18 in a manner creating substantially even dispersion of the silicone.

Not withstanding the foregoing, it will be understood by those skilled in the relevant art that a glass block panel system may be formed according to steps 102 and 104 of method 100 of the invention in a manner different from the illustrated embodiment. For example, once either or both vertical peripheral frame members 18 and vertical internal frame spacer 16 have been positioned, but prior to the entirety of compartments 11 being formed by the positioning of horizontal internal frame spacers 16, adhesive sealant 13 may be applied to any desired location in the portions of compartments 11 that will bond glass blocks 12 to framework 4 and/or create a seal between glass blocks 12 and framework 4. Accordingly, adhesive sealant 13 may be applied to portions of compartments 11 corresponding to the outer edges and/or corners of glass blocks 12 when installed in conjunction with framework 4 of glass block panel system 2. Alternatively, adhesive sealant 13 may be applied to the outer edges and/or corners of glass blocks 12 prior to their insertion into framework 4 of glass block panel assembly 2.

Step 106 of method 100 is to latitudinally insert at least one glass block. Latitudinally inserting at least one glass block in step 106 may involve any number of steps and implementing components, and latitudinally inserting at least one glass block may be accomplished readily by those with ordinary skill in the art from the disclosure herein. Accordingly, in one embodiment of the invention, latitudinally inserting at least one glass block may be accomplished by latitudinally inserting at least one glass block into the portion of the at least one compartment from a front of the glass block panel system. In other embodiments of the invention, latitudinally inserting at least one glass block may be accomplished by latitudinally inserting a plurality of glass blocks into portions of the framework compartments from a front of the glass block panel system.

For the exemplary purposes of this disclosure and turning to FIGS. 7–8, step 106 in fabrication method 100 of latitudinally inserting at least one glass block may be accomplished by latitudinally inserting glass blocks 12 into framework compartments 11 from a front of glass block panel system 2. This is in stark contrast to conventional construction techniques for glass block structures that involve insertion of glass blocks longitudinally from the top of the glass block structure as previously explained.

Because glass blocks 12 may be latitudinally slid in from the front of framework 4, adhesive sealant 13 does not build up in excess at the bottom corners of compartments 11 in contrast to conventional construction techniques. As glass blocks 12 are laterally slid into position, adhesive sealant 13 is generally dispersed in an even fashion along the four edges of the block 12 creating a sufficient seal devoid of holes or gaps. Further, because glass blocks 12 may be laterally slid in from the front, framework 4 may be assembled prior to insertion of any glass blocks 12. This allows for greater installation versatility as framework 4, or even a portion of framework 4, may be pre-assembled separately on-site or off-site at a different location, where glass blocks 12 may then be inserted into glass block panel system 2.

Referring to FIGS. 2 and 4, once inserted, glass block 12 abuts portions of internal base web portions of peripheral frame member 18 and internal frame spacer 16. Glass block 12 comprises front half 32 and back half 34. Front half 32 and back half 34 are first molded into the proper shape and then pressed together until they fuse. Seam 30 indicates the fusion location. Seam 30 thus girdles glass block 12 substantially at the midpoint of its thickness. Glass block 12 is substantially square, although other shapes are possible, including, but not limited to, other rectilinear shapes (e.g. rectangular, hexagonal, octagonal, or triangular shapes) and curvilinear shapes. Recessed surface 36 of glass block 12 allows protruding features of peripheral frame 18 and internal frame spacer 16, such as flanges 42 and flanges 52, to fit between peripheral frame 18 or internal frame spacer 16 respectively and glass block 12 while glass block 12 abuts portions of internal base web portions of peripheral frame member 18 and internal frame spacer 16. Because recessed surface 36 comprises all four sides of glass block 12, peripheral frame 18 and internal frame spacer 16 may each fit closely against each side of glass block 12.

Step 108 of method 100 is to complete the glass block panel system. Completing the glass block panel system in step 108 may involve any number of steps and implementing components, and completing the glass block panel system may be accomplished readily by those with ordinary skill in the art from the disclosure herein. Accordingly, in one embodiment of the invention, completing the glass block panel system may be accomplished by coupling removable side arms to peripheral frame members and coupling removable facing strips to internal frame spacers. In other embodiments of the invention, completing the glass block panel system may be accomplished by coupling top horizontally positioned peripheral frame member 18 to peripheral framework 6 and internal framework 8, and then coupling removable side arms to peripheral frame members and removable facing strips to internal frame spacers.

For the exemplary purposes of this disclosure and referring to FIGS. 7–8, once glass blocks 12 have been inserted into framework 4 of glass block panel system 2, step 108 in fabrication method 100 of completing the glass block panel system may be accomplished by coupling removable side arms 38 to peripheral frame members 18 and coupling removable facing strips 58 to internal frame spacers 16. Accordingly, this step may be accomplished by applying adhesive sealant 13, as depicted, to portions of glass block panel system 2 to be covered by the inner surfaces of cross-arms 59 of facing strips 58 (or, alternatively, applying adhesive sealant 13 to the inner surfaces of cross-arms 59 of removably coupled facing strips 58). Similarly, adhesive sealant 13 may be applied, as depicted, to portions of glass block panel system 2 to be covered by the inner surfaces of removably coupled side arms 38 (or, alternatively, applying adhesive sealant 13 to the inner surfaces of removably coupled side arms 38). Ribbed portions 60 of facing strips 58 may then be inserted into narrow receptacles 62 of internal frame spacers 16, and external latching flanges 41 of removable side arms 38 are then inserted into U-shaped receptacles 47 of peripheral frame members 18 so as to seal glass blocks 12 and fully complete the fabrication of glass block panel system 2.

As depicted in FIG. 2, because front half 32 and back half 34 of glass block 12 may not be aligned perfectly when fused together, flexible extrusions 40*b* and 40*a* on supporting side arm 24 and removably coupled supporting side arm 38 respectively provide for a tightly adjustable seal on abutting glass block 12. Removably coupled supporting side arm 38 has exterior latching flanges 41 designed to latch with internal latching flanges 43 forming U-shaped receptacle 47 running along second longitudinal end 45 of peripheral frame member 18. Those skilled in the art would appreciate that other structures may be utilized to couple removable side arm 38 to peripheral frame 18. For example, the internal surface of U-shaped receptacle 47 and the exterior surface of flanges 41 may alternatively be ribbed instead of latch-shaped and/or may alternatively comprise only one flange 41.

Turning to FIG. 3, internal frame spacer 16 is attached to peripheral frame 18. Internal frame spacer 16 is connected to peripheral frame 18 by generally T-shaped securing tab 46 with flanges 48 configured to interconnect with securing track 44 with flanges 42 of peripheral frame member 18. Like the interface with glass block 12, flexible extrusions 40*a* and 40*b* also provide for a tightly adjustable seal on internal frame spacer 16.

Referring to FIG. 4, internal frame spacer 16 is generally asymmetrical. Thus, frame spacer 16 may interface with two different glass blocks 12 on opposing base web portions of spacer 16. Furthermore, because frame spacer 16 may intersect any side of glass block 12, spacer 16 may provide structural internal framework for block 12 both horizontally along course 14 or vertically along column 11 as shown in FIG. 7. Central securing track 50 of spacer 16 is formed between flanges 52. Securing track 50 allows frame spacer 16 to be attached to other spacers 16 in glass block panel system 2. Along first longitudinal end 55 of frame spacer 16 is facing strip 54 having cross-arm 53 with corresponding flexible extrusion 40*d*. Running longitudinally between facing strip 54 and flange 52 of securing track 50, is at least one perpendicularly protruding rib 56 rising out of the base web portion of frame spacer 16, although at least one perpendicularly protruding rib 56 does not have to be included.

Turning to FIG. 5, attachment of facing strip 58 (which is substantially T-shaped) is accomplished by insertion of ribbed portion 60 of facing strip 58 into ribbed portion 62 of U-shaped narrow internal receptacle 64 along second longitudinal end 65 of internal frame spacer 16, thereby creating a tightly adjustable seal between glass block 12 and an internal frame spacer 16. The seal is employed by the engagement of flexible extrusions 40*c* and 40*d* on the surface of the block 12. Because removably coupled facing strip 58 may be inserted to various insertion lengths into narrow receptacle 64, the distance between facing strip 54 and removably coupled facing strip 58 is adjustable and may account for geometry variations in glass block 12 and the like. Also, because the dimensions of glass block 12 might not be perfectly asymmetrical, block 12 may not contact frame spacer 16 evenly. Thus the elasticity of flexible extrusions 40*c* formed on cross arms 59 of removably coupled facing strip 58 allow the interface between glass block 12 and internal frame spacer 16 to be tightly, yet adjustably, sealed as extrusions 40*c* flex to accommodate various facing strip 58 insertion depths and differing glass block 12 dimensions. Similarly, the elasticity of flexible extrusions 40*d* formed on cross arms 53 of frame spacer facing strip 54 allow the interface between glass block 12 and an internal frame spacer 16 to be tightly, yet adjustably sealed as extrusions 40*d* flex to accommodate differing glass block 12 dimensions.

Thus, FIG. 9 depicts a fully fabricated and ready to install glass block panel system 2 according to an embodiment of the present invention as formed according to steps 102–108 of fabrication method 100. Accordingly, glass block panel system 2 comprises four external peripheral frame members 18 forming a framed periphery around four glass blocks 12. Blocks 12 are secured in place by: silicone dispersed between internal frame spacers 16 and peripheral frame members 18; side arms 24 and facing strips 54 of the peripheral frame members 18 and internal frame spacers 16 respectively; and removably coupled side arms 38 and removably coupled facing strips 58 coupled into corresponding receptacles 47 and 64 respectively.

For the exemplary purposes of this disclosure, glass block panel system 2 and fabrication method 100 provide many advantages over conventional glass block structures and construction techniques. One advantage is method 100 forms glass block panel system 2 in a manner that improves the efficiency of fabrication. Framework 4 is configured so as to allow latitudinal insertion of glass blocks 12 into framework 4 from a front face of glass block panel system 2. Another advantage is that method 100 forms glass block panel system 2 in a manner that enhances its sealant capabilities. Framework 4 is configured to tightly, yet adjustably, secure and seal glass blocks 12 within framework 4 when glass block panel system 2 is fully assembled. That is, supporting side arms 38 and 24 of peripheral frame members 18, cross-arms 59 and 53 of facing strips 58 and 54 of internal frame spacers 16, each have flexible extrusions 40*a*–40*d* respectively coupled along and extending outwardly from each of the exposed ends (tips) thereof. Flexible extrusions 40*a*–40*d* are in an angled position. In this way, flexible extrusions 40*a*–40*d* flex back from their bent position while abutting installed glass blocks 12, thereby creating a seal between glass blocks 12 and extrusions 40*a*–40*d*. Thus, the length, angle, and especially the flexibility of flexible extrusions 40*a*–40*d* allow them to compensate for virtually any gap between installed blocks 12 and extrusions 40*a*–40*d* while still forming a seal between blocks 12 and extrusions 40*a*–40*d*.

Glass block panel systems according to embodiments of the invention may be pre-assembled and then shipped in one unitary piece to a construction site. Conventional glass block structures cannot withstand the strain of transportation without cracking or sustaining other damage. In contrast, the framework and adhesive sealant of the present invention may be flexible and may bend and flex in reaction to pressures experienced during transport. Because of this, glass block panel systems may be built to a customer's specifications in the manufacturing facility and then shipped as a unit in a ready-to-install piece to an installation location of the customer's choice.

Glass block panel systems according to embodiments of the invention may be installed easily into structure openings and may account for structure finish thickness variations and opening depths. For the exemplary purposes of this disclosure, to install glass block panel system 2 in a wall of a wood framed building for example, glass block panel system 2 may be placed into an opening in the wall such that mounting fins 20 are flush with wall studs surrounding the wall opening. Nails, or any other fastening device, such as screws, tacks, or pins, may then be driven through mounting fins 20 and into the wall studs. Each mounting fin 20 may be adapted to lie flush against the face of its corresponding wall stud so that fasteners may be driven through mounting fins 20 and into the wall studs.

Stop 22 acts as a boundary to which stucco, bricks, stones, siding, paneling, or other finish on the building under construction may be brought, thereby covering and obscuring mounting fin 20 from view. Removably coupled mounting fin 20 comprises exterior latching flanges 21 designed to latch with internal latching flanges 23 forming of U-shaped receptacle 27 running along the bottom of first longitudinal end 25 of peripheral frame member 18. Those skilled in the art would appreciate that other designs could be utilized to couple removable mounting fin 20 to peripheral frame 18. For example, the internal surface of U-shaped receptacle 27 and the exterior surface of flanges 21 may be dimpled instead of latch-shaped, or the surfaces may be reversed such that the external flanges are included on peripheral frame member 18 and the internal flanges are included on mounting fin 20. Because mounting fin 20 is removable and reversible, the varying thicknesses of different finishes on the building may be accommodated and/or the lateral position of glass block panel system 2 may be adjusted within the opening in the wall, including the complete removal of mounting fin 20 if desired.

The embodiments and examples set forth herein were presented in order to best explain the invention and its practical application and to thereby enable those of ordinary skill in the art to make and use the invention. However, those of ordinary skill in the art will recognize that the foregoing description and examples have been presented for the purposes of illustration and example only. The description as set forth is not intended to Le exhaustive or to limit the invention to the precise form disclosed. Many modifications and variations are possible in light of the teachings above without departing from the spirit and scope of the forthcoming claims. Accordingly, unless otherwise specified, any components of the invention indicated in the drawings or herein are given as an example of possible components and not as a limitation. Similarly, unless otherwise specified, any steps or sequence of steps of any fabrication method of the invention indicated herein are given as examples of possible steps or sequence of steps and not as limitations.

The invention claimed is:

1. A glass block panel system comprising:

a framework comprising:

an external framework comprising at least one external peripheral frame member comprising a base web portion formed between first and second opposing side arms, wherein at least one of the side arms is removably coupled to the base web portion; and at least one glass block secured in the framework.

2. The glass block panel system of claim 1, the at least one external peripheral framework member further comprising a securing track formed along an internal face of the base web portion.

3. The glass block panel system of claim 1, the at least one external peripheral framework member further comprising flexible extrusions protruding from tips of the side arms, the extrusions forming tightly adjustable seals between the tips of the side arms and the glass block.

4. The glass block panel system of claim 1, the at least one glass block further comprising at least two glass blocks secured in the framework, and the framework further comprising an internal framework comprising at least one internal frame spacer abutting and separating the at least two glass blocks.

5. The glass block panel system of claim 4, the internal frame spacer comprising a spacer web portion formed between opposing facing strips.

6. The glass block panel system of claim 5, each facing strip further comprising cross arms, the cross arms having flexible extrusions protruding from tips of the cross arms forming tightly adjustable seals between the tips of the cross arms and the glass blocks.

7. The glass block panel system of claim 5, wherein at least one of the facing strips is removably coupled to the spacer web portion.

8. The glass block panel system of claim 1, wherein the first side arm is removably coupled to the base web portion and the second side arm is integrally joined to the base web portion.

9. A glass block panel system comprising:

at least two glass blocks secured in a framework; and the framework comprising:

an internal framework comprising at least one internal frame spacer abutting and separating the at least two glass blocks, the at least one internal frame spacer comprising a spacer web portion formed between first and second opposing facing strips, each facing strip comprising cross arms, the cross arms having flexible extrusions protruding from tips of the cross arms forming tightly adjustable seals between the tips of the cross arms and the glass blocks.

10. The glass block panel system of claim 9, wherein at least one of the facing strips is removably coupled to the spacer web portion.

11. The glass block panel system of claim 10, wherein the first facing strip is removably coupled to the spacer web portion and the second facing strip is integrally joined to the spacer web portion.

12. The glass block panel system of claim 9 further comprising a securing track formed along at least one opposing face of the spacer web portion.

13. The glass block panel system of claim 12, the internal frame spacer further comprising a securing tab formed at each opposing latitudinal end of the spacer web portion.

14. The glass block panel system of claim 9, the framework further comprising an external framework comprising at least one external peripheral frame member.

15. The glass block panel system of claim 14, the at least one external peripheral frame member comprising a base web portion formed between opposing side arms.

16. The glass block panel system of claim 15, the at least one external peripheral frame member comprising a mounting fin reversibly coupled to the base web portion.

17. The glass block panel system of claim 15, the at least one external peripheral frame member further comprising flexible extrusions protruding from tips of the side arms, the extrusions forming tightly adjustable seals between the tips of the side arms and the at least two glass blocks.

18. The glass block panel system of claim 15, wherein at least one of the side arms is removably coupled to the base web portion.

19. The glass block panel system of claim 15, the at least one external peripheral frame member further comprising a securing track formed along an internal face of the base web portion.

* * * * *